US005804786A

United States Patent [19]

Braaten

[11] Patent Number: 5,804,786

[45] Date of Patent: Sep. 8, 1998

[54] SWITCH OPERATING MECHANISM

[76] Inventor: Ronald J. Braaten, 85 Braaten Hill Rd., Woodstock, Conn. 06281

[21] Appl. No.: 719,671

[22] Filed: Sep. 25, 1996

[51] Int. Cl.[6] ..... H01H 3/14

[52] U.S. Cl. ..... 200/86.5; 200/1 B; 200/16 C

[58] Field of Search ..... 200/1 R, 5 R, 200/5 B, 5 C, 6 R, 17 R, 18, 1 B, 16 C, 52 R, 86.5, 520, 341, 521, 16 R, 335, 339, 343

[56] References Cited

U.S. PATENT DOCUMENTS 2,857,493 10/1958 Tascher ..... 200/86
3,433,914 3/1969 Ericsson ..... 200/159
4,293,746 10/1981 Braaten ..... 200/86.5
4,354,071 10/1982 Pietschmann ..... 200/86.5
4,586,398 5/1986 Yindra ..... 74/512
4,843,200 6/1989 Parlatore et al. ..... 200/553

*Primary Examiner*—Michael L. Gellner
*Assistant Examiner*—Michael A. Friedhofer

[57] ABSTRACT

An operating mechanism is disclosed for effecting actuation of rheostats, air valves, electric switches and the like using a single spring having a single apex whose movement effect operation of one or more devices. A further mechanism is disclosed for effecting movement of the spring apex whereby at least one additional spring is engaged during movement of the spring apex to provide increased resistance to movement of the spring apex thereby to provide tactile indication of the position of the operating mechanism.

14 Claims, 4 Drawing Sheets

SWITCH OPERATING MECHANISM

FIELD OF THE INVENTION

The present invention generally relates to operating mechanisms for rheostats, air valves, electric switches and the like using a mechanical force input to effect operation and has particular utility with switches intended to be foot operated and offers two stage operation easily sensed by the operator.

BACKGROUND OF THE INVENTION

Foot operated controls intended to actuate a variety of control elements while freeing a machine operators hands are generally heavy, often cast iron structures intended to be stable in floor placement, durable in manufacturing shop environments and reliable in operation. The desire to secure dual control element actuation and sequential operation of control elements often produced unwanted structural complexity, large size and cumbersome operation.

OBJECTS OF THE INVENTION

It is a primary object of this invention to provide a small, easy to operate, low physical profile, mechanically operated actuator device such as a foot switch, that is economical to manufacture, durable in use and easily configured to perform a variety of control functions.

It is a further object of this invention to provide a foot operated switching device having a single foot engageable operator and having at least two electrical switches mounted in side-by-side relationship within the device, the operator movement by a foot serving to actuate a single operating mechanism to actuate the two electric switches, each of which can be of the normally closed or normally open type.

An additional object of the invention is to provide a foot operated switching device having plural electric switches arranged in side-by-side relationship with a single operating mechanism actuating both switches wherein tactile pressure indicates the position of the switch operating mechanism and thereby indicates to the operator, the operating position of the plural switches.

Other objects will be in part obvious and in part pointed out more in detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

A small, low profile actuating mechanism for electric switches, valves and other similar mechanically actuated devices is provided having a housing bottom, a housing top pivotally connected to the housing bottom and moveable relative thereto, the top and bottom housings serving to substantially enclose the actuating mechanism. The devices to be actuated are mounted on the housing bottom or on a frame secured to the bottom; in a preferred embodiment, 2 miniature switches are mounted or fixed in position relative to the bottom with the switch actuators facing each other and the conductors connected to the switche terminals extending outwardly through a suitable aperture in the housing bottom. A spring member, having torsion spring portions in the preferred embodiment, is supported on the housing bottom and provided with two legs joined at an apex that is engageable with the top to "flex" the spring. One leg is engaged with the bottom and the other leg has a portion extending between the switch operators with its end secured.

Pivoting of the housing top into engagement with the spring apex causes the legs to deflect and to also to deflect the leg extension portion into or out of engagement with one of the switch actuators to effect operation of the switch. It has been found that use of a torsion spring configuration at the apex of the spring member and a torsion spring configuration between one leg of the spring member and the leg extension is advantageous to the smooth functioning of the mechanism. Use of an upwardly biased spring whose rest position is spaced from the top but engageable intermediate the ends of pivoting travel of the top housing so that engagement provides additional resistance to top housing; hence, there is tactile feel intermediate the travel of the spring extension thereby to provide clear indication of two stage operation of the switches.

DESCRIPTION OF PREFERRED EMBODIMENTS

Figure 1:
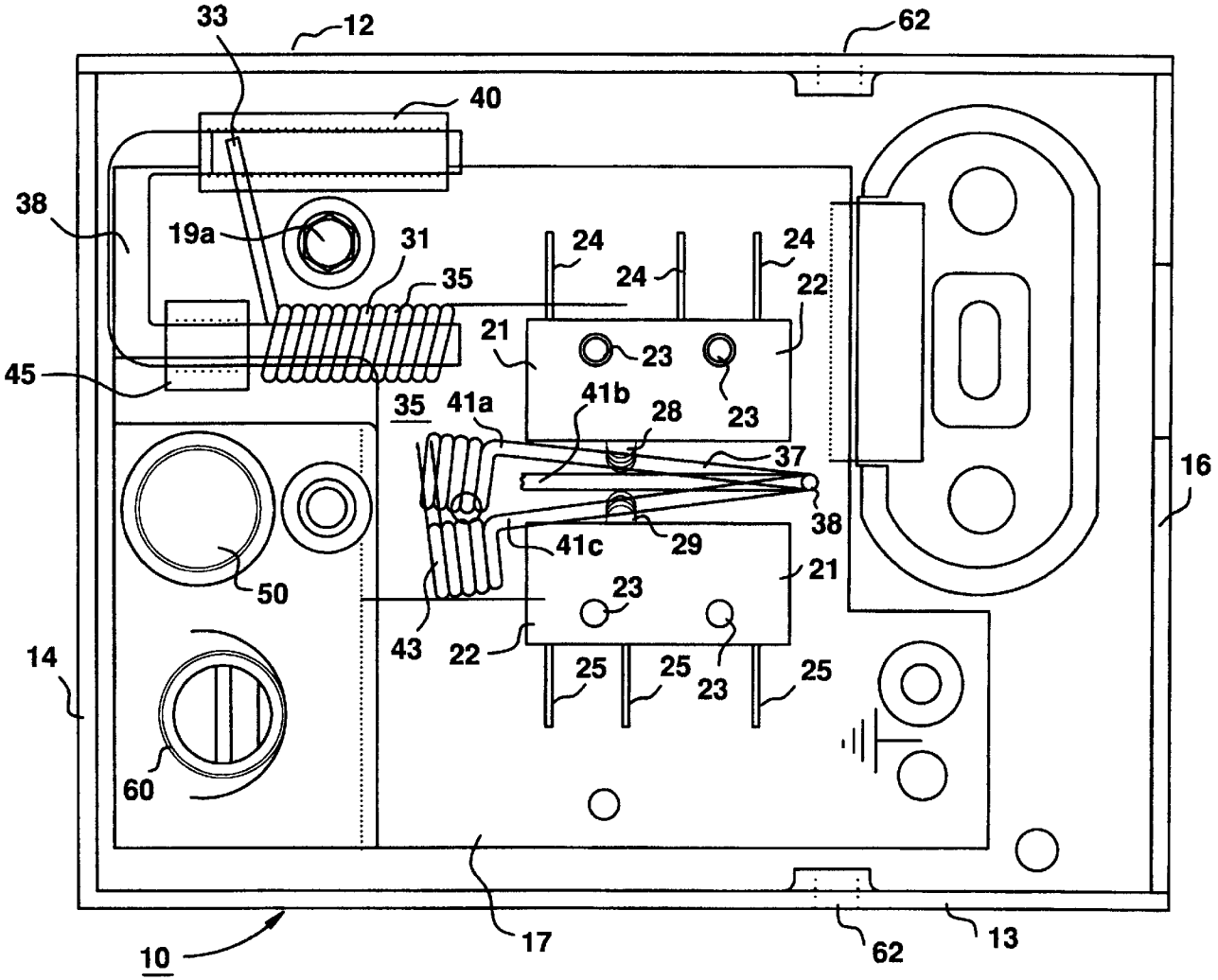
FIG. 1 is a top plan view of a preferred embodiment of the mechanism of this invention with the top housing removed and illustrating plural operating positions of the spring member.

Referring now to the drawings and initially to FIGS. 1 and 2 thereof, a foot switch incorporating the actuating mechanism of this invention is shown as comprising a bottom housing 10, preferably formed of stamped sheet metal, having side walls 12 and 13, a front wall 14 and a rear wall 16, side walls 12 and 13 being tapered in width from rear wall 16 to front wall 14 to accommodate movement of the top housing as hereinafter explained. Sheet metal base 17 is suitably fastened to bottom 10, base 17 serving to form a convenient mounting for the internal components of the switch. As seen most clearly in FIG. 3, base 17 is configured to be suitably secured by fasteners 17*a* to bottom 10 in spaced relation thereto as determined by suitable projections 18 (only one of which is shown), which spacing is utilized in the mounting of eyelet or button 50 and its associated spring 53 received therein. A pair of electrical switches 21 and 22 are mounted on base 17 by suitable fasteners 23. The switches 21 and 22 are, in the illustrated version are generally referred to as subminiature snap switches such as are manufactured by Cherry Electrical Products and Microswitch Division of Honeywell Corp. The switches are in the illustrated embodiment, suitably mounted as at 23 on their sides and electrical connections are made to terminals 24 and 25 as desired. As shown more clearly in FIG. 2 which schematically illustrates that the connections can be made to provide a normally open switch or a normally closed switch, all sequence as the user may desire by appropriate connection of electrical conductors 27. Each snap switch is provided with an operator 28 (switch 22) and 29 (switch 21) for conventional actuation of the electrical switch. It should be noted that the switches are selected for their facility in being side mounted to reduce the profile height of the entire switch assembly and either switches can be connected, as desired, in either the normally open or normally closed configuration as well as in different sequences of operation. Moreover solenoid valves and other valves can be substituted for the switches and other modifications made without departing from this invention.

Figure 4:
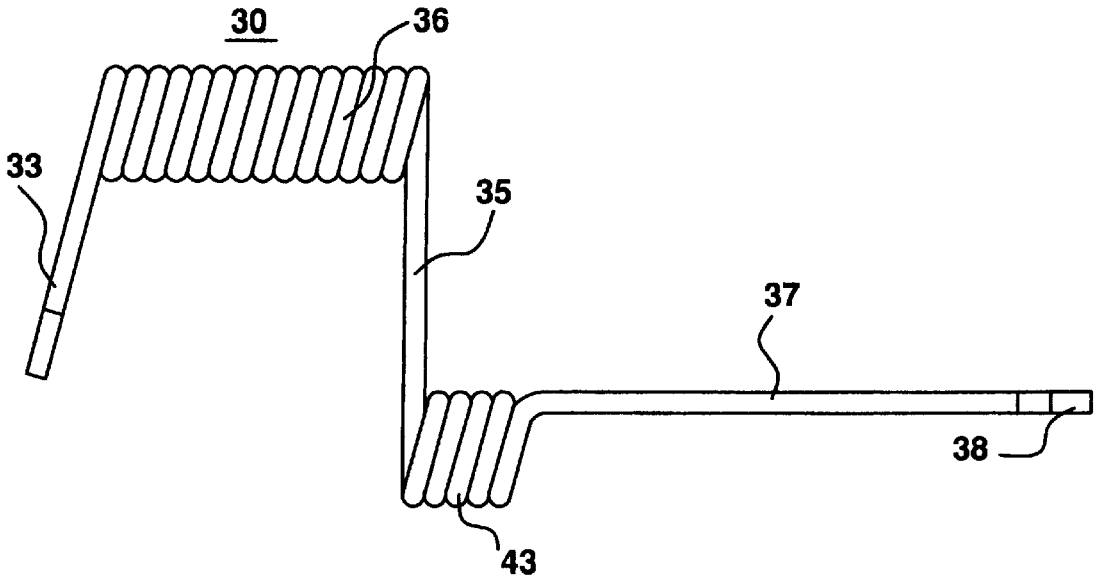
FIG. 4 is a side view of a preferred embodiment of the spring member.
Figure 5:
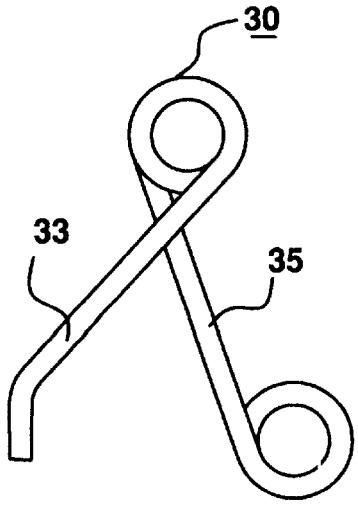
FIG. 5 is an end view of the spring member of FIG. 4.

Referring now to the drawings and particularly to FIGS. 4 and 5, it is seen that the element that functions as the switch actuator is a spring member generally designated 30, which spring member has an apex generally designated 31, a first leg 33, and a second leg 35, leg 35 having an extension 37 which is provided with an end portion 38 secured to base 17 in any suitable manner.

In the form of the spring shown in FIGS. 4 and 5, it has been found advantageous to provide a torsion spring configuration at apex 31 which torsion spring portion 36 facilitates repeated flexing of the legs 33 and 35. Torsion spring portion 36 is preferably supported on a generally U-shaped member 38, having one end being rotatably received in a channel 40 in base 17 and the other end extending into the coils of the torsion spring portion 36 of apex 31 most clearly seen in FIG. 1. Additionally it is such that leg 33, because of the nature the stress that is placed on torsion spring 35 need only engage the channel 40 or bottom 10 to fix it in position. As a matter of ease of operation, there is provided a suitable roller 45 made of materials such as nylon or the like which is mounted on one leg of U-shaped member 38 extending to the coils of the torsion spring 36 thereby facilitating easy movement of top housing 63 and flexure of spring member 30 as will be hereinafter pointed out in greater detail.

In the illustrated preferred embodiment leg 35 of spring 30 is provided with a torsion spring portion 43 to interconnect the leg extension 37 with leg 35 and the main spring portion to provide a durable easily and reliably moveable switch actuator leg extension 37.

Figure 2:
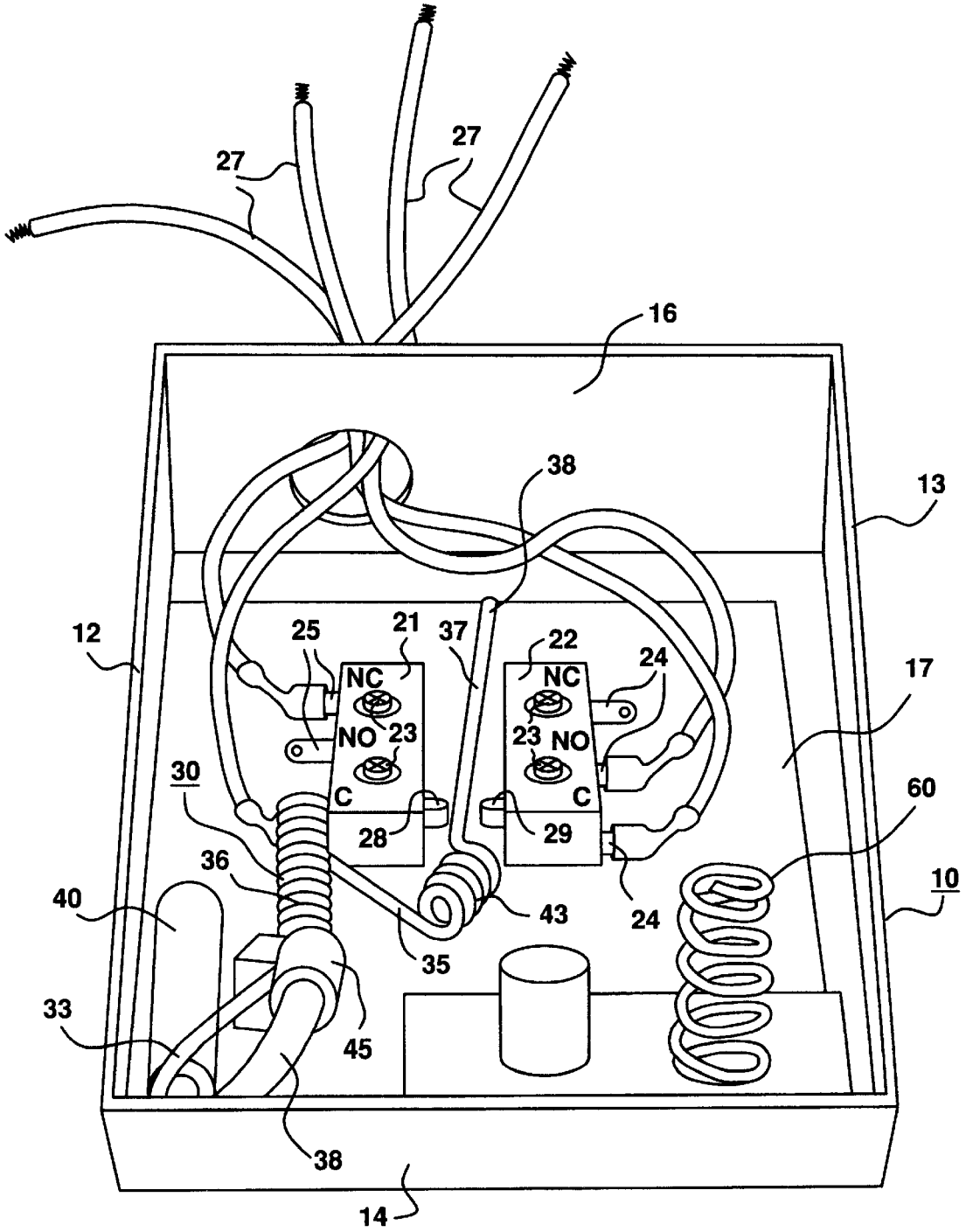
FIG. 2 is a perspective view of the embodiment of FIG. 1.

As most clearly seen in FIG. 1, extension 37 is shown in three positions, 41*a*, 41*a* and 41*c* to clearly demonstrate the movement of leg extension 37 and spring portion 43 as the apex 31 is depressed. The provision of dual torsion springs provide increased durability and longevity for this operating mechanism. The switch operators 28 and 29 are also shown in variable positions to disclose operation by extension 37 in the portions 41*a*, 41*b* and 41*c*.

An important feature of the invention, is eyelet or button 50 which is provided with a flared end 50*a* (see FIG. 3) which traps the eyelet or button 50 so that it is constantly biased in an upward position by spring 53, the upward position as limited by engagement of the eyelet flared end 50*a* with the side wall of a suitable aperture in frame 17. The depressed position of eyelet 50 is shown at 54 wherein spring 53 is compressed.

For convenience (and if desired) return spring 60 can be provided and mounted to frame 17 to assist the return of top housing 63 under the spring action provided by spring actuator 30. Top housing 63 is shown in 2 positions in FIG. 3, housing 63 having been pivoted about pivot points 62.

Figure 3:
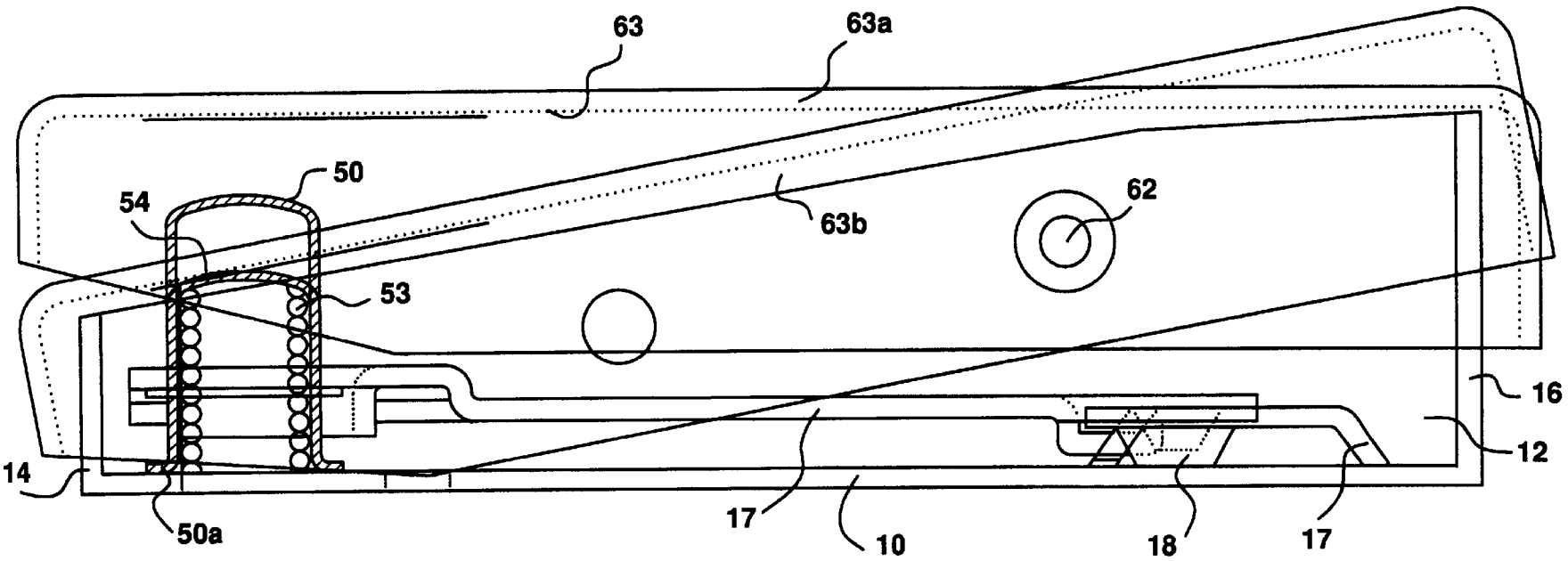
FIG. 3 is a side elevation partial cross section view of a portion of the housing showing the housing top actuator in two extreme operating positions and showing the spring button housing in two extreme positions.

Turning now to FIG. 3, it is seen that top housing or cover 63 is shown in two positions, the "up" position 63*a* and the "depressed" position 63*b*. As the operator moves cover 63 towards base 10, the switch operator spring member is flexed and extension 37 provides the desired switch actuation.

A particular advantage of the present switching mechanism is that it can operate two separate switches (and their associated circuits) during the course of complete travel of the cover 63 from the position 63*a* to the position 63*b*. However as is best seen in FIG. 3 as the cover moves down and initially flexes the spring extension 37, extension 37 will move to permit actuation of operator 28 of switch 22. Further downward travel causes cover 63 to engage eyelet button 50 which, because of its spring 53, requires additional downward force to continue movement of extension 37 and hence provides tactile indication of the engagement of the extension 37 with the operator 29 of switch 21. Spring 53 is shown in the compressed position which corresponds to position 41*c* of the spring extension 37 as shown in FIG. 1.

Many alternatives utilizing the spring member actuation system of the present invention can be accomplished depending upon the use and duty cycle that is expected. For example, spring 30 need not be supported on U-shaped member 38 except in an expected heavy duty situation. Moreover the provision of the torsion spring sections 36 and 43 in spring member 30 provides for heavy duty operational action but can be eliminated for light duty situations. Similarly the provision of the return spring 60 to engage cover 63 and urge it to its up position is an optional feature depending upon the use and duty cycle of the mechanism.

It is however of considerable significance that the present invention provides for the operation of two switches with a single mechanical motion, the actuation of the second switch being signaled to the operator by the tactile feedback required by compression of the spring 53 and the eyelet or button 50.

The present switch because of its novel operating mechanism and utilization of sub miniature and miniature switching devices can be made to have a very low profile and because of the material selected be provided with a low manufacturing cost. Moreover, extreme durability results from the simplicity of design.

Although this invention has been illustrated and described with respect to exemplary embodiments thereof, it should be understood by those skilled in the art that various changes, omissions and additions may be made without departing from the spirit and scope of the invention.

I claim:

1. A switch actuator for electrical switches, valves and the like comprising a spring member having an apex and first and second legs extending from said apex, each leg having a terminal end, a frame supporting said spring and having at least one switch secured thereto, said switch having an operator therefor said first leg of said spring having a terminal end engaging said frame, said second leg of said spring having a portion thereof extending at an angle toward a position adjacent to the operator for said one switch, the extending portion of said second leg having an end secured to the frame whereby movement of the apex of said spring causes said portion of said second leg to move relative to said switch operator to effect operation thereof.

2. The switch actuator as set forth in claim 1 wherein said apex between said first and second legs is formed by a torsion spring interconnecting said first and second legs.

3. The switch actuator as set forth in claim 2 wherein said extending portion of said second leg is joined to said second leg by a torsion spring engageable with and movable along said frame.

4. The switch actuator as set forth in claim 1 wherein a second switch having an operator is secured to said frame in proximity to the first switch and said portion of said second leg extends between the operators for each of said switches whereby movement of said apex of said spring causes said portion of said second leg to move relative to said switch operators to selectively engage and disengage both of said switch operators to effect operation thereof.

5. A two switch actuator comprising the switch actuator of claim 1 wherein a second switch with an operator, said first and second switches, each having an actuator, are mounted in generally juxtaposed relationship on said frame with the operator of each of said switches positioned so as to face the other switch operator and said portion of said second leg extends between said operators so as to be engageable ad seriatim with each said actuator upon movement of said portion of said second leg upon movement of said apex of said spring.

6. The switch actuator of claim 1 wherein a bottom housing is provided for mounting said frame and a top housing is provided, said top housing being pivotally connected to said bottom housing member whereby movement of said top housing toward said bottom housing causes engagement of said top housing with said apex of said spring to effect movement of said apex of said spring member thereby to effect switch actuation.

7. The switch actuator of claim 6 wherein an upwardly biased spring button is mounted on said bottom housing and engageable by said top housing and said spring member engages the top housing to bias said top housing away from said bottom housing about the pivot connection.

8. The switch actuator of claim 2 wherein a generally U-shaped member is pivotally connected to the frame and extends through coils of said torsion spring interconnecting said first leg and said second leg, said U-shaped member having roller thereon engageable with the top housing and an additional torsion spring is provided for connecting said second leg with said second leg portion.

9. The two switch actuator of claim 5 wherein a bottom housing mounts said frame, a top housing is pivotally connected to said bottom housing and an upwardly biased spring button is mounted on said bottom housing, said spring member being engageable by the top housing to effect movement of said portion of said second leg whereby initial movement of said top housing to move said spring member moves said portion to actuate said first switch operator and further movement of said top housing engages and depresses the upwardly biased spring button to provide tactile indication of engagement therewith and whereby further movement of said top housing continues movement of said portion of said spring to actuate said second switch operator.

10. The switch actuator of claim 4 wherein said first switch and said second switch are generally secured to said frame in side-by-side relationship.

11. The two switch actuator of claim 9 wherein a return spring is provided to assist a force from said spring member and to provide a restoring force to return the top housing to an initial position.

12. The switch actuator of claim 1 wherein said spring member is generally "V"-shaped and is secured to said frame in inverted position.

13. A two stage foot switch actuator comprising a frame, two switches mounted in juxtaposition on said frame, each said switch having an operator, the operator of one switch being positioned in opposition to the operator of the other switch, a first spring member having a leg portion extending between the operators of the two switches and having an end secured to the frame, said first spring member being engageable by a foot-engageable top member to effect deflection of said spring leg portion to engage the operator of one of said switches thereby to operate said one of said switches, a spring button being spaced from said top member and engageable therewith after travel of said top member sufficient to deflect said spring leg position to operate said one of said switches whereby further travel of said top member engages said button to compress the button to signal travel of said leg portion to operate the other of said switches.

14. The switch actuator of claim 13 wherein the spring member and the button provide a restoring force to said top member.

* * * * *